US008757062B2

(12) United States Patent
Content et al.

(10) Patent No.: US 8,757,062 B2
(45) Date of Patent: Jun. 24, 2014

(54) METHOD FOR PRINTING WATER-SOLUBLE FILM

(75) Inventors: Stephane Content, Brussels (BE); Frank William Denome, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 339 days.

(21) Appl. No.: 12/781,150

(22) Filed: May 17, 2010

(65) Prior Publication Data

US 2010/0294153 A1 Nov. 25, 2010

Related U.S. Application Data

(60) Provisional application No. 61/179,390, filed on May 19, 2009.

(51) Int. Cl.
*B41M 1/04* (2006.01)
*B65B 61/02* (2006.01)
*B41F 5/24* (2006.01)

(52) U.S. Cl.
USPC ..... 101/483; 101/219; 510/296

(58) Field of Classification Search
USPC ..... 101/483, 491, 219; 510/296
See application file for complete search history.

(56) References Cited

U.S. PATENT DOCUMENTS

| | | | | |
|---|---|---|---|---|
| 2,477,383 | A | 7/1949 | Lewis | |
| 2,734,375 | A | 2/1956 | Galbraith et al. | |
| 3,526,391 | A | 9/1970 | Church et al. | |
| 3,903,328 | A | 9/1975 | Burdette, Jr. et al. | |
| 4,170,681 | A | 10/1979 | Edwards et al. | |
| 4,289,815 | A | 9/1981 | Lee | |
| 4,528,226 | A | 7/1985 | Sweeney | |
| 4,830,902 | A | 5/1989 | Plantenga et al. | |
| 4,844,828 | A | 7/1989 | Aoki | |
| 4,939,992 | A | 7/1990 | Bird | |
| 4,997,504 | A * | 3/1991 | Wood | 156/204 |
| 5,217,037 | A | 6/1993 | Bristol | |
| 5,458,590 | A | 10/1995 | Schleinz | |
| 5,630,363 | A | 5/1997 | Davis et al. | |
| 5,666,785 | A | 9/1997 | Jouffreau et al. | |
| 5,766,732 | A | 6/1998 | Claytor | |
| 5,931,771 | A | 8/1999 | Kozyuk | |
| 5,942,064 | A | 8/1999 | Krenkel et al. | |
| 6,035,779 | A | 3/2000 | Helms | |
| 6,035,897 | A | 3/2000 | Kozyuk | |
| 6,492,095 | B2 | 12/2002 | Samworth | |
| 6,787,512 | B1 | 9/2004 | Verrall et al. | |
| 6,846,784 | B2 | 1/2005 | Engel et al. | |
| 7,517,847 | B2 | 4/2009 | Catalfamo et al. | |
| 2003/0056667 | A1 * | 3/2003 | Cruttenden et al. | 101/219 |
| 2003/0154871 | A1 * | 8/2003 | Laksin et al. | 101/211 |
| 2006/0000540 | A1 | 1/2006 | Mathea et al. | |
| 2006/0032387 | A1 | 2/2006 | Watanabe et al. | |
| 2006/0257596 | A1 | 11/2006 | Catalfamo et al. | |
| 2006/0258553 | A1 | 11/2006 | Catalfamo et al. | |

(Continued)

FOREIGN PATENT DOCUMENTS

| | | | |
|---|---|---|---|
| EP | 1504994 | B1 | 7/2007 |
| EP | 1 948 771 | B1 | 12/2010 |

(Continued)

*Primary Examiner* — Leslie J Evanisko
(74) *Attorney, Agent, or Firm* — Melissa G. Krasovec; Steven W. Miller

(57) ABSTRACT

A method for on-line printing onto water-soluble film on-line with water-soluble detergent pouch process.

19 Claims, 1 Drawing Sheet

(56) References Cited

U.S. PATENT DOCUMENTS

| | | | | |
|---|---|---|---|---|
| 2008/0041020 | A1 | 2/2008 | Alexandre Catlin et al. | |
| 2008/0139440 | A1 | 6/2008 | Catalfamo et al. | |
| 2008/0226919 | A1* | 9/2008 | Hosoda et al. | 428/411.1 |
| 2009/0120316 | A1 | 5/2009 | Denome | |
| 2009/0123679 | A1 | 5/2009 | Denome | |

FOREIGN PATENT DOCUMENTS

| | | | |
|---|---|---|---|
| EP | 1 467 864 | B1 | 7/2012 |
| JP | 55-034966 | | 3/1980 |
| WO | WO 00/20128 | | 4/2000 |
| WO | WO 02/16205 | A1 | 2/2002 |
| WO | WO 02/40351 | | 5/2002 |
| WO | WO 2006/130144 | A1 | 12/2006 |
| WO | WO 2007/010553 | | 1/2007 |
| WO | WO 2007/034471 | A2 | 3/2007 |
| WO | WO 2007/130684 | A1 | 11/2007 |
| WO | WO 2009/112992 | A1 | 9/2009 |

* cited by examiner

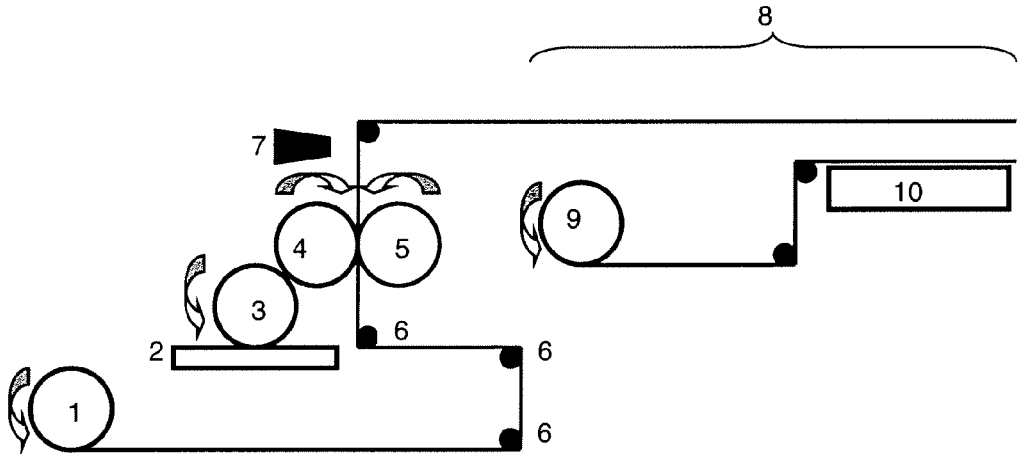
8
7
10
9
4
5
3
6
2
6
1
6

METHOD FOR PRINTING WATER-SOLUBLE FILM

CROSS REFERENCE TO RELATED APPLICATION

This application claims the benefit of U.S. Provisional Application No. 61/179,390, filed May 19, 2009.

TECHNICAL FIELD

The current invention relates to a method for continuously printing onto water-soluble film on-line with a water-soluble detergent pouch preparation process.

BACKGROUND OF THE INVENTION

Printing onto water-soluble film is known in the art. WO 2007034471 A2 (Icht) relates to a water-soluble detergent printed film comprising a film support and at least one print, being printed thereon and/or therein said film, said film comprises a water-soluble detergent adapted for effective cleansing of various human body and goods cleaning. U.S. Pat. No. 5,666,785 (Chris-Craft Industrial Products Inc.) relates to printing directly onto a water-soluble film. More particularly it relates to a method and apparatus for printing graphics and text directly onto water-soluble films while the film is in the process of being formed into a water-soluble container by a packaging machine. The printing process initiates when the packaging machine halts film transport temporarily during the form, fill and seal cycle that produces the water-soluble container. JP 55-034966 (Toppan Printing Co Ltd.) relates to printing onto fruits with distortionless impressions without causing damage to the fruits. This method involves printing onto a water-soluble film, pasting the film onto the fruits by using adhesive, and then removing the film by dissolution. Water-soluble detergent pouch preparation is known in the art. WO 02/40351 (Procter & Gamble) relates to a process for preparing water-soluble pouches. EP 1504994 B1 (Procter & Gamble) discloses a process at manufacturing a water-soluble multi-compartment pouch. US 2008/0041020 A1 (Procter & Gamble) relates to a water-soluble multi-compartment dishwashing pouch.

Off-line printing is used in labeling of packaging material and is accomplished by printing on packaging material in a distinct and separate process before the packaging material is installed on a packaging machine. Generally, this off-line printing process requires rolls of packaging material to be unwound, printed and then heated to dry. The packaging material is then rewound into rolls, and stored before delivering to the actual packaging process.

Water-soluble detergent pouches have been prepared from off-line printed water-soluble film. This process has been disclosed in co-pending patent application Ser. Nos. 12/270,534 and 12/270,547 (Procter & Gamble).

Off-line printing employs excessive process steps and significantly slows the process of producing packaging. Further, because the printing process is distinct from the actual packing process, the necessary equipment is remote from one another and therefore the entire operation requires a large area. Furthermore, excessive manipulation of the water-soluble film in unwinding and rewinding the film may affect the integrity and robustness of the water-soluble film itself. Loss of integrity and robustness will negatively affect the quality of the final product. Excess manipulation can also lead to increased scrap levels due to start-up and shut down of each process. Costs associated with handling this scrap must be considered. Another disadvantage of off-line printing is the storage of the printed material, which requires additional space to be stored. Off-line printing also creates a risk of printing an excess of a design.

There is a need for a method in which a water-soluble film can be continuously printed and then directly used in a pouch making process.

SUMMARY OF THE INVENTION

A method to produce a water-soluble detergent pouch, having a graphic printed thereon, said method comprising feeding a water-soluble film through, a) at least one flexographic printing unit; and then b) a water-soluble detergent pouch producing unit;

characterized in that the water-soluble film is formed into pouches immediately after flexographic printing onto said water-soluble film.

BRIEF DESCRIPTION OF DRAWINGS

FIG. 1 shows flexographic printing unit on-line with water-soluble pouch producing unit.

DETAILED DESCRIPTION OF THE INVENTION

FIG. 1 illustrates the present invention. However said illustration is by way of example only and is not meant to be limiting.

The method of the present invention comprises a flexographic printing unit. Flexographic printing is a direct rotary printing method, which uses flexible printing plates generally made of rubber or plastic. The printing plates, with a slightly raised printing area, are rotated on a cylinder forming a design roll which transfers the image to the substrate.

By the term on-line it is meant that the flexographic printing unit and water-soluble pouch preparation unit are juxtapose to one another. Unlike off-line printing, the printed water-soluble film is not stored before use in pouch producing unit.

By the term printable material it is meant inks and coloring agents, as well as over print varnish, gels, liquids, powders, perfume micro capsules and other functional materials.

The flexographic printing unit preferably comprises a printable material tray (2), a printable material transfer roll called anilox roll (3), a design roll (4) and an impression roll (5).

In a single printable material printing process, one flexographic unit is required. In a multiple printable material printing process, the water-soluble film is passed through a plurality of flexographic printing units. Printable material from different flexographic units can be printed onto the same water-soluble film. Printing in this fashion permits the manufacturer to produce multi-colored images or image portions having a variety of desired printable materials, designs and effects. In the multiple printable material printing process, a plurality of flexographic printing units can be positioned on-line, one after another or plurality of the flexographic printing units can be positioned around one large central impression cylinder to produce multi-colored images or image portions.

Printable Material Tray and Printable Material

A printable material tray (2) comprises a supply of printable material. In a preferred embodiment the printable material supply is continuously circulating the printable material, thus controlling the viscosity of the printable material. If the viscosity of the printable material is too high, the printable material may dry on the surface of the design roll. This has a negative effect on the quality of the printing, because the printable material will not be transferred completely onto the surface of the water-soluble film during the printing process. The printable material can have water-like consistency, having a low viscosity or alternatively, can have a paste-like consistency, and high viscosity. Importantantly however, to secure high quality printing, it is preferred to keep the viscosity of the printable material constant during the printing process. Viscosity of the printable material can be manipulated by the addition of water or other solvent. In a preferred embodiment the printable material has a viscosity of from 300 cP to 10000 cP, more preferably from 800 cP to 8000 cP and more preferably from 1000 cP to 5000 cP.

The appropriate printable materials for the present application are suitable for printing onto a water-soluble film and for the resulting film to have the desired properties of dissolution index and opacity index. The printable material itself should also provide a desired dispersion grade in water. The printable material for the present application is preferably ink, coloring agent, over print varnish, gel, powder or mixtures thereof. More preferably the printable material is an ink. Most preferably the printable material is a water-soluble ink.

When colored, the color of the printable material is preferably selected from white, red, blue, yellow, green, pink, purple, orange, black, gray, pink and mixtures thereof. In one embodiment, where the printable material selected has a color other than white, an over print varnish is preferably also applied onto the surface of the water-soluble film over the ink. Most preferably the ink is white.

Most preferable water-soluble inks are inks known under the trade reference SunChemical Aquadestruct, sold by SunChemical, New Jersey, US, and inks of corresponding characteristics. Other suitable inks are known under the trade names Aqua Poly Super Opaque White QW000046, Film III Opaque White FR EC007094, Stable Flex ES Opaque White SFX02700, Plus 0700 Pro Plus Opaque White Plus 0700 all sold by Environmental Inks and Opta Film OPQ White W0L009656 sold by Water Ink Technologies Incorporated and inks of corresponding characteristics.

Over Print Varnish

The present invention may comprise a further flexographic printing unit for printing a water-soluble over print varnish onto the previously printed material, and optionally the water-soluble film. The advantage of an over print varnish it to render the printed material smear-resistant. An additional purpose of the over print varnish on water-soluble film is to improve storage stability, in particular in a high-humidity environment. Furthermore over-print varnish can also improve the feel of the printed film.

Suitable over print varnishes for printing onto water-soluble film are those that permit the resulting film to have the desired properties of dissolution index and opacity index. The over print varnish itself should also provide a desired dispersion grade in water. Preferred over-print varnish is water-soluble. Technically over print varnish is ink without dye component, comprising isopropyl alcohol, water and preferred polymers. Preferred polymers provide desired technical features and give a structure to the over print varnish. Most preferable over print varnish which is known under the trade reference OPV Aquadestruct, sold by SunChemical, New Jersey, US, and over print varnishes of corresponding characteristics. The proprietor of the preferred over print varnish is SunChemical.

The over print varnish may be printed onto the surface of the water-soluble film. In one preferred embodiment, the printable material is located between the water-soluble film and the over print varnish.

Functional Material

The printable material may comprise functional material to be printed onto the water-soluble film. The functional material may be in solid, gel or liquid form or a solid suspended in a gel or liquid. The functional material is preferably selected from the group consisting of bleach, bleach activators, perfume micro-capsules, pearlescent agents, coloring agents, and whitening agents including hueing dyes and photo bleach as disclosed in co-pending application EP 08158232.2. The latter requiring an over print varnish layer to ensure adhesion to the film a reducing rubb off for better performance in the wash. The purpose of these functional materials is to improve washing effect of the detergent or provide additional physiological or visual effect.

Dispersion Grade

Dispersion Grade as used herein is a grading scale used to rank the behavior of the printable material, after the water-soluble film on which it is printed dissolves.

A grade of 1 on the Dispersion Grade correlates to a printable material that fully disperses in water during the Dissolution Test Method below. A grade of 2 correlates to a printable material that somewhat disperses in water, in that small size pieces (less than or equal to 1 mm) are present in the water during the Dissolution Test Method. A grade of 3 correlates to a printable material that minimally disperses, resulting in large pieces (greater than 1 mm) of film remaining in the water during the Dissolution Test Method.

Preferably the Dispersion Grade for the printable material of the present application should be less than 2. More preferably the Dispersion Grade for the printable material of the present application should be 1.

Dissolution Test Method

For the Dissolution Test Method below the water-soluble film is aged for 24 hours at 21° C. (+/−1.5° C.) and 50% relative humidity (+/−1.5% relative humidity) by being exposed without being covered or otherwise protected from the temperature and humidity.

Cut three test specimens of the water-soluble film sample to a size of 3.8 cm×3.2 cm. Lock each specimen in a separate 35 mm slide mount. Fill a suitable beaker with 500 mL of distilled water. Measure water temperature with thermometer and, if necessary, heat or cool water to maintain a constant temperature of 20° C. Mark height of column of water. Place beaker on magnetic stirrer, add magnetic stirring rod to beaker, turn on stirrer, and adjust stir speed until a vortex develops which is approximately one-fifth the height of the water column. Mark depth of vortex.

Secure the 35 mm slide mount in an alligator clamp of a slide mount holder such that the long end of the slide mount is parallel to the water surface. The depth adjuster of the holder should be set so that when dropped, the end of the clamp will be 0.6 cm below the surface of the water. One of the short sides of the slide mount should be next to the side of the beaker with the other positioned directly over the center of the stirring rod such that the film surface is perpendicular to the flow of the water.

In one motion, drop the secured slide and clamp into the water and start the timer. Disintegration occurs when the film breaks apart. When all visible film is released from the slide mount, raise the slide out of the water while continuing to monitor the solution for undissolved film fragments. Dissolution occurs when all film fragments are no longer visible and the solution becomes clear. The time limit for the dissolution test is 15 minutes. If the film is not dissolved during 15 minutes, the test is terminated. Record the individual and average disintegration and dissolution times and water temperature at which the samples were tested.

The Dissolution Index, as used herein, relates to a comparison value between dissolution of an unprinted water-soluble film and a printed water-soluble film, where otherwise both water-soluble films have the same characteristics, composition, thickness and manufacturing.

Dissolution index=Dissolution time of the printed Film/Dissolution time of the unprinted film The Dissolution Index for the printed water-soluble film for the present application should be less than 1.5, preferably less than 1.3.

Opacity Index

Opacity Index as used herein, is an index relating to the adherence of the printable material to the water-soluble film surface. Abrasion resistance is a desirable and sometimes critical property of printed materials. Abrasion damage can occur during shipment, storage, handling, and end use. The result is a significant decrease in product appearance and legibility of printed design. The amount of abrasion damage to a printed substrate is dependent on shipping conditions, possibly temperature and humidity, time, and many other variables. This test method provides a way of comparing abrasion resistance of printed materials under laboratory conditions. This test method also can be used to evaluate the relative abrasion resistance of printed inks, coatings, laminates, and substrates.

The opacity is the measure of the capacity of a printed material to obscure what is in the background. A value for opacity is determined by dividing the reflectance with black backing (RB) for the material, by the reflectance obtained for the same material with white backing (RW). This is called the contrast ratio method. Opacity is measured with a Reflectance Spectrophotometer Hunter Labscan XE, Hunter D25DP9000 supplied by HunterLab or equivalent.

Opacity=RB/RW

In this application the opacity of a printed film is calculated by dividing reflectance of printed film after the Sutherland rub test (SRt), by the reflectance obtained from the same material before the Sutherland Rub test. The Sutherland rub test method described in details below.

Opacity=(RB of Printed film After SRt/RW of Printed film after SRt)/(RB of Printed film before SRt/ RW of Printed film before SRt)

The Opacity index in the current application is preferably greater than 0.38, more preferably greater than 0.50, most preferably greater than 0.85.

The Sutherland Rub Test: ASTM Designation D 5264 Standard Test Method for Abrasion Resistance Test Method:

Print at least one rectangular block of at least 10 cm×15 cm of ink onto the water-soluble film. Precondition the sets of printed water soluble film samples for a minimum of 2 hours at 24° C.+/−2° C. Actual relative humidity of this environment should be between 45% and 50%. Samples should be separated sufficiently so both sides of the sample are equilibrated at this condition. Place the printed water-soluble film sample being tested on the flat surface of the Sutherland rub test machine base. Use masking tape to hold the sample in place and flat as it has a tendency to curl. Sutherland Ink Rub Tester, U.S. Pat. No. 2,734,375, supplied by the Brown Company, Serial Number R-1049.

Use a 1 ml syringe, place 0.2 ml of the liquid having the formulation shown in Table 1 onto the secured printed water-soluble film sample in a sinusoidal wave on top of the printed block.

Cut a Buehler micro cloth (20 cm×6.5 cm) and attach to the 1.8 kg (4 lbs) metal block in the Sutherland 2000 Rub tester. This metal block is providing the abrasion. Set dial indicator for the desired number of strokes; 20 cycles should be used.

TABLE 1

| Material | Parts (%) |
|---|---|
| Glycerine | 2.48 |
| Neodol C11 E9[1] | 2.63 |
| SLF-18[2] | 44.69 |
| Dipropylene Glycerol | 41.84 |
| Water | 7.55 |

[1]nonionic surfactant of carbon chain length 11 and an ethoxylation level of 9.
[2]Plurafac SLF-18, Low foaming linear alocohol alkoxylate surfactant, sold by BASF Printable Material Transfer Roll Printable material transfer roll (3) transfers the printable material from the printable material tray (2) to the design roll (4).

A printable material transfer roll (3), also commonly known as an anilox roll, is a hard cylinder, usually constructed of a steel or aluminum core which is coated by an industrial ceramic. The surface often contains a plurality of fine uniform dimples, known as cells. The cells carry and deposit a thin, controlled layer of printable material. The printable material transfer roll (3) is located on top of the printable material tray (2) and adjusted to dip into the printable material tray (2) while rotating above it. The printable material transfer roll dips into the printable material tray (2). The characteristics of the cells of the printable material transfer roll (3) determine the amount of ink that will be transferred to the design roll: angle of the cells, cell volume, and line screen. The cell volume is a measure of how much printable material is deposited into a single cell. Lower cell volume means the cell contain less ink. The angle defines the angle of the cells in reference to the axis of the printable material transfer roll. Preferably the angle is 30 degrees, 45 degrees or 60 degrees. A 60 degree angle ensures maximum density in a given space. Line count indicates how many cells there are per linear inch. Low line count will allow for a heavy layer of ink to be printed, whereas high line count will permit finer detail in printing. Both cell volume and line count is closely correlated. The printable material transfer rolls are often specified by the number of cells per linear inch.

The printable material transfer rolls are designed to be removed from the flexographic printing unit for cleaning and for exchange with different line screen ink transfer rolls. Depending on the detail of the images to be printed, a printable material transfer roll with a higher or lower line count will be selected. Low line count rolls are used where a heavy layer of ink is desired, such as in heavy block lettering. Higher line count rolls produce finer details and are used in four-color process work.

In the current application the printable material transfer roll the cells are in 50-70 degree angle, preferable in 60 degree angle. In the current application cell volume is 6-12 bcm more preferably 8-10 bcm. The line count is 160-200 lines per linear inch more preferably 180 lines per linear inch.

Design Roll

A design roll (4) transfers the image to the water-soluble film. A flexible printing plate is made preferably of rubber or plastic is affixed around the rotating cylinder to form the design roll (4). The flexible printing plate comprises printing areas. The solid printing areas of the plate are slightly raised above the non image areas on the rubber or polymer plate. The design roll (4) rotates to contact with the printable material transfer roll. Printable material is transferred from the cells of the printable material transfer roll (3) to the design roll (4). Printable material is transferred in a uniform thickness evenly and quickly to the cells of the raised printing areas of the design roll (4).

Impression Roll

The impression roll (5) is a hard cylinder usually constructed of steel or aluminum core, which is used to apply pressure to the design roll (4). The water-soluble film is fed between the design roll (4) and the impression roll (5). When in use the design roll (4) and impression roll (5) transfer the printable material to the water-soluble film. The impression cylinder (5) is located horizontally to the design roll (4) and is rotating contrary to the design roll (4).

Most preferred flexographic printing unit is known under the trade reference Proglide 13 ", sold by Comco.

Stretching Unit

In a preferred embodiment water-soluble film is unrolled from the water-soluble film roll (1) and transported for printing through a stretching unit (6) successive 90° turns, driven by rollers which slightly tension and stretch the water-soluble film. Control the thickness of the film and removes any wrinkles.

Drying Unit

The flexographic printing unit in the present application may further comprise a drying unit (7). The drying unit will preferably apply a line of pressurized air across the printed water-soluble film and across the direction of travel of said water-soluble film to dry any printed water-soluble film.

Water-Soluble Film

As used herein "water-soluble" means a film that dissolves under the water-soluble test method above at 20° C. within 90 seconds. A detailed discussion of the test method to obtain dissolution information can be found in U.S. Pat. No. 6,787,512 B1.

Preferred water-soluble materials are polymeric materials, preferably polymers which are formed into a film or sheet. The water-soluble film can, for example, be obtained by casting, blow-molding, extrusion or blown extrusion of the polymeric material, as known in the art.

Preferred polymers, copolymers or derivatives thereof suitable for use as water-soluble film are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the water-soluble film, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the water-soluble film. This can be beneficial to control the mechanical and/or dissolution properties of the water-soluble film, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising 1-35% by weight polylactide and 65% to 99% by weight polyvinyl alcohol.

Preferred for use herein are polymers which are from 60% to 98% hydrolysed, preferably 80% to 90% hydrolysed, to improve the dissolution characteristics of the material.

Most preferred water-soluble films are PVA films known under the trade reference Monosol M8630, as sold by Mono-Sol LLC of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The water-soluble film herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

Transfer of the Printed Water-Soluble Film from Printing Unit to Pouch Preparation The transfer of the printed water-soluble film from the printing unit to the water-soluble pouch preparation unit occurs immediately without any interruptions or rewinding of the printed water soluble film. The distance, which the printed water-soluble film is transferred from the printing unit to the pouch producing unit, is adjusted to ensure that the printable material is absorbed and/or dried on a surface of the water-soluble film prior to pouch formation.

The printable material partially absorbs into the water-soluble film and partially dries on the surface. Most preferably said absorption and drying takes between 1 and 5 seconds, more preferably 2 to 3 seconds. The amount of printable material printed onto the water-soluble film affects the absorption and drying rate. In a preferred embodiment 1-30 $g/m^2$ of printable material is printed onto the surface of the water-soluble film to gain optimal printing quality and absorption and drying rate, preferably 10-18 $g/m^2$ and more preferably 5-15 $g/m^2$ of printable material is printed onto the surface of the water-soluble film. In a preferred embodiment 2-100% of the film area is printed, more preferably 5-60% of the film area is printed and most preferably 10-30% of the film area is printed.

The water-soluble film is preferably transported 5-15 m/min, more preferably 8-12 m/min, and most preferably 9-11 m/min. By adjusting the distance between the printing unit and the pouch preparation and the quantity of printable material delivered to the film, the absorption and drying of the ink can be secured and smearing avoided. Preferably the distance between the printing unit and pouch preparation unit is 1 to 5 m, more preferably 2 to 3 m.

During the printed water-soluble film transportation a tension should preferably be applied to the water-soluble film to avoid wrinkling of the water-soluble film.

Process for Producing the Water-Soluble Detergent Pouches

The printed water-soluble film will be formed immediately without any interruptions into a pouch or a unit dose container. The contents of the pouch or unit dose container may include liquids, gels, solids, powders and mixtures thereof. The pouch preferably comprises detergent.

Each water-soluble detergent pouch is formed in a single mold. The molds can have any shape, length, width and depth, depending on the required dimensions of the pouch. The molds can also vary in size and shape from one to another, if desirable. For example, it may be preferred that the volume of the final pouches is between 5 and 300 ml, or even 10 and 150 ml or even 20 and 100 ml or even up to 80 ml and that the mold size are adjusted accordingly.

The process for preparing water-soluble detergent pouches (8) comprises the step of shaping pouches from said water-soluble film in a series of mould (10). By shaping it is meant that the water-soluble film is placed onto and into the moulds, so that said film is flush with the inner walls of the moulds. This is can be achieved by combination of thermo and vacuum forming. Thermoforming is a system by which heat is applied to a film. As the film is heated it becomes flexible and more malleable. The vacuum forming involves the step of applying a vacuum onto a mould, sucking the water-soluble film into the mould. Vacuum forming ensures the water-soluble film adopts the shape of the mould. Preferably the film is gently heated to make malleable and then vacuum formed in the mould. For example, the vacuum drawing the water-soluble film into the mold can be applied only for 0.2 to 5 seconds, or even 0.3 to 3 or even 2 seconds, or even 0.5 to 1.5 seconds, once the water-soluble film is on the horizontal portion of the surface. This vacuum may preferably be such that it provides pressure of between −100 mbar to −1000 mbar or even −200 mbar to −600 mbar.

The water-soluble film is sealed by any sealing means. For example, by heat sealing, solvent sealing or by pressure sealing. In the present invention a sealing source is contacted to the water-soluble film delivering solvent and heat or pressure. The sealing source may be a solid object, for example a metal, plastic, or wood object. If heat is applied to the water-soluble film during the sealing process, then said sealing force is typically heated to a temperature of from 40° C. to 200° C., preferably 40° C. to 140° C. and more preferably 40° C. to 120° C. If pressure is applied to the film during the sealing process, then the sealing source typically applies a pressure from $1\times10^4$ $Nm^{-2}$ to $1\times10^6$ $Nm^{-2}$ to the water-soluble film.

Preferably more than one sheet of film is used in the process to produce water-soluble detergent pouches. The present invention preferably uses two separate sheets of water-soluble film. In this process the first water-soluble film (9) is vacuum formed into the moulds. A desired amount of detergent composition is then poured into the moulds. A second water-soluble (1) is positioned such that it overlaps with the first water-soluble film (9). The first water-soluble film and second water-soluble film are sealed together. The first piece of water-soluble film and second piece of water-soluble film can be the same type of water-soluble film or can be different.

Preferably in the present invention the second water-soluble film is the printed film, such that the graphic is preferably printed onto the top side of said water-soluble film. Preferably the printed material is not in a contact with water-soluble detergent composition.

Most preferred pouch preparation unit is known under the trade reference VEC, as sold by Fameccanic.

Graphics/Indicia

The graphics or indicia of the present application may be any text, symbol or shape that can be printed onto the surface of a water-soluble film. In some embodiments, the graphic or indicia indicates the origin of said unit dose product; the manufacturer of the unit dose product; an advertising, sponsorship or affiliation image; a trade mark or brand name; a safety indication; a product use or function indication; a sporting image; a geographical indication; an industry standard; preferred orientation indication; an image linked to a perfume or fragrance; a charity or charitable indication; an indication of seasonal, national, regional or religious celebration, in particular spring, summer, autumn, winter, Christmas, New Years; or any combination thereof. Further examples include random patterns of any type including lines, circles, squares, stars, moons, flowers, animals, snowflakes, leaves, feathers, sea shells and Easter eggs, amongst other possible designs.

The size and placement of the graphics selected are carefully selected to ensure than an entire graphic is present on each unit dose product. In one embodiment, at least three different size graphics are utilized. The graphics can either be the same or different.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method to produce a water-soluble detergent pouch, having a graphic printed thereon, said method comprising:

continuously feeding a water-soluble film comprising polyvinyl alcohol through at least one flexographic printing unit wherein the water-soluble film is transported from 5 to 15 m/min to form a printed water-soluble film;

and then transferring said printed water-soluble film to a water-soluble detergent pouch producing unit, wherein the preparation of the pouch comprises the step of shaping pouches in a series of moulds by thermoforming;

wherein said printed water-soluble film is formed into pouches immediately after flexographic printing onto said water-soluble film.

2. The method according to claim 1, wherein said flexographic printing unit comprises, a printable material, a printable material tray (2), a printable material transfer roll (3), a design roll (4), an impression roll (5); and wherein said printable material is transferred from said printable material tray via said printable material transfer roll and said design roll to said water-soluble film.

3. The method according to claim 2, wherein said printable material is selected from the group consisting of ink, coloring agent, over print varnish, gel, powder, liquid, and mixtures thereof.

4. The method according to claim 2, wherein said printable material has viscosity of from 300 cP to 10000 cP.

5. The method according to claim 2, wherein the printable material has a color selected from the group consisting of white, red, blue, yellow, green, pink, purple, orange, black, gray and mixtures thereof.

6. The method according to claim 2 comprising further flexographic unit, printing a water-soluble over print varnish onto the previously printed material and optionally the water-soluble film.

7. The method according to claim 2, wherein said printable material further comprises a functional material.

8. The method according to claim 7, wherein said functional material is selected from the group consisting of bleach, bleach activators, perfume micro-capsules, pearlescent agents, and coloring agents.

9. The method according to claim 2, wherein said printable material is an ink.

10. The method according to claim 2, wherein said printable material is a water-soluble ink.

11. The method according to claim 1, said method comprising one flexographic unit, for single printable material printing.

12. The method according to claim 1, said method comprising a plurality of flexographic printing units for multiple printable material printing.

13. The method according to claim 1, wherein said flexographic printing unit further comprises a drying unit.

14. A method to produce a water-soluble detergent pouch, having a graphic printed thereon, said method comprising:

continuously feeding a water-soluble film comprising polyvinyl alcohol through at least one flexographic printing unit to form a printed water-soluble film, wherein said at least one flexographic printing unit comprises a printable material comprising a water-soluble ink;

and then transferring said printed water-soluble film to a water-soluble detergent pouch producing unit, wherein the preparation of the pouch comprises the step of shaping pouches in a series of moulds by thermoforming;

wherein said printed water-soluble film is formed into pouches immediately after flexographic printing onto said water-soluble film.

15. The method according to claim 14, wherein more than one sheet of film is used to produce water-soluble detergent pouches.

16. The method according to claim 15, wherein a first water-soluble film is vacuum formed into the moulds, a desired amount of detergent composition is poured into the moulds, a second water-soluble film is positioned such that it overlaps with the first water-soluble film, and the first water-soluble film and the second water-soluble film are sealed together.

17. The method according to claim 14, wherein the printable material is selected to provide a Dispersion Grade of less than 2.

18. The method according to claim 14, wherein the printable material and the water-soluble film are selected to provide a printed water-soluble film with a Dissolution Index of less than 1.5.

19. The method according to claim 14, wherein the printable material and the water-soluble film are selected to provide a printed material with an Opacity index of greater than 0.38.

* * * * *